US008343890B2

(12) United States Patent
Arai et al.

(10) Patent No.: US 8,343,890 B2
(45) Date of Patent: Jan. 1, 2013

(54) HEAT-SENSITIVE TRANSFER IMAGE-RECEIVING SHEET

(75) Inventors: Takuya Arai, Minami-ashigara (JP); Masaaki Miki, Kanagawa (JP); Kazuaki Oguma, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 378 days.

(21) Appl. No.: 12/846,123

(22) Filed: Jul. 29, 2010

(65) Prior Publication Data

US 2011/0027503 A1 Feb. 3, 2011

(30) Foreign Application Priority Data

Jul. 31, 2009 (JP) ..... 2009-179903

(51) Int. Cl.
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 5,098,883 A * 3/1992 Aono ..... 503/227

FOREIGN PATENT DOCUMENTS

JP 2007-237617 A 9/2007
JP 2009-083331 A 4/2009

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet having, on a support, at least one heat insulation layer and at least one receptor layer in this sequence, the receptor layer containing a latex polymer and a polyether-modified silicone represented by a specific formula, and the receptor layer containing at least one anionic surfactant represented by other two specific formulae.

3 Claims, No Drawings

HEAT-SENSITIVE TRANSFER IMAGE-RECEIVING SHEET

FIELD OF THE INVENTION

The present invention relates to a heat-sensitive transfer image-receiving sheet used in a dye diffusion transfer recording.

BACKGROUND OF THE INVENTION

In a dye diffusion transfer recording system, a heat-sensitive transfer sheet (hereinafter simply also referred to as an ink sheet) containing a colorant (hereinafter also referred to as a dye) is superposed on a heat-sensitive transfer image-receiving sheet (hereinafter simply also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consist of the three colors and black are used for recording a color image by overlapping one color to other, thereby enabling transferring and recording a color image having continuous gradation for color densities.

In recent years, as a result of the popularization of dye diffusion transfer recording-type systems and speeding-up of printing, those systems have been installed out of doors such as in amusement parks and tourist attractions, so that they have been used for an immediate printing purpose.

JP-A-2007-237617 ("JP-A" means unexamined published Japanese patent application) discloses a heat-sensitive transfer image-receiving sheet provided, on a heat insulation layer, with a receptor layer which contains a vinyl chloride-based latex and carnauba wax and utilizes an anionic fluorine-based compound.

JP-A-2009-83331 discloses a heat transfer image-receiving sheet provided with a receptor layer which contains a vinyl chloride-based latex and a polyether-modified silicone, and makes use of a nonionic surfactant.

However, a new problem occurred. That is, when images are printed out with the systems intended for the immediate printing in the outdoors as described above using these heat-sensitive transfer image-receiving sheets, a separation line occurs in black and high-density image areas.

This separation line (hereinafter, may also be referred to as sticking), which is one of failures occurring at the time of image formation, will be explained below.

In the dye diffusion transfer recording type systems, a heat-sensitive transfer sheet and a heat-sensitive transfer image-receiving sheet are superposed, and an image is formed. Since the image is formed on the heat-sensitive transfer image-receiving sheet, the heat-sensitive transfer sheet which has become unnecessary, needs to be peeled off without leaving any unnecessary matters or traces on the heat-sensitive image-receiving sheet.

However, as there is a demand for shortening the printing time, the temperature applied to the heat-sensitive transfer sheet upon recording tends to be set higher (and therefore, the heating time is shortened). Accordingly, the heat-sensitive transfer sheet and the heat-sensitive transfer image-receiving sheet do not peel off in succession, and there occur changes in the conveyance load, so that an image failure that leaves streak-shaped marks (separation lines) caused by peeling is prone to occur. Depending on the situation, the heat-sensitive transfer sheet partly fuses into the heat-sensitive transfer image-receiving sheet after printing.

Particularly when the printing environment is under high temperature and high humidity conditions, such as during the rainy season or in rainy weather in summer time, the separation lines are likely to occur, and when these failures are present in printed images, the defects may impair the image quality.

Thus, it has been strongly demanded to overcome these problems.

SUMMARY OF THE INVENTION

The present invention resides in a heat-sensitive transfer image-receiving sheet comprising, on a support, at least one heat insulation layer and at least one receptor layer in this sequence, the receptor layer containing a latex polymer and a polyether-modified silicone represented by the following formula (S1), and the receptor layer containing at least one anionic surfactant represented by the following formula (A1) or (A2):

Formula (S1)

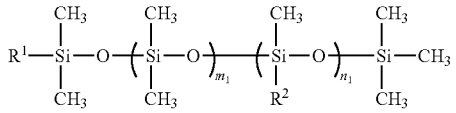

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represent a positive integer; $a_1$ represents a positive integer; and $b_1$ represents 0 or a positive integer;

Formula (A1)

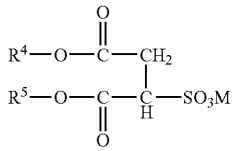

wherein $R^4$ and $R^5$ each independently represent an alkyl group having 3 to 20 carbon atoms; and M represents a hydrogen atom or a cation; and Formula (A2)

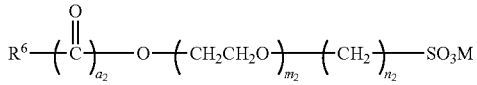

wherein $R^6$ represents an alkyl group or an alkenyl group, each having 6 to 20 carbon atoms; M represents a hydrogen atom or a cation; $m_2$ represents the average number of added moles, and is larger than 0 and equal to or less than 10; $n_2$ represents an integer of 0 to 4; and $a_2$ represents 0 or 1.

Other and further features and advantages of the invention will appear more fully from the following description.

DETAILED DESCRIPTION OF THE INVENTION

According to the present invention, there is provided the following means:

[1] A heat-sensitive transfer image-receiving sheet comprising, on a support, at least one heat insulation layer and at least one receptor layer in this sequence, the receptor layer containing a latex polymer and a polyether-modified silicone represented by the following formula (S1), and the receptor layer containing at least one anionic surfactant represented by the following formula (A1) or (A2):

Formula (S1)

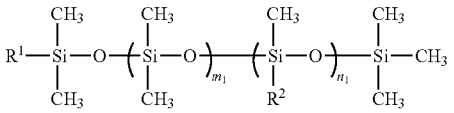

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represent a positive integer; $a_1$ represents a positive integer; and $b_1$ represents 0 or a positive integer;

Formula (A1)

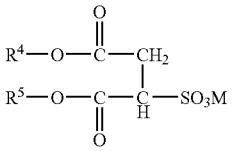

wherein $R^4$ and $R^5$ each independently represent an alkyl group having 3 to 20 carbon atoms; and M represents a hydrogen atom or a cation; and Formula (A2)

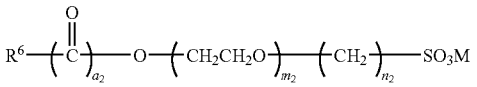

wherein $R^6$ represents an alkyl group or an alkenyl group, each having 6 to 20 carbon atoms; M represents a hydrogen atom or a cation; $m_2$ represents the average number of added moles, and is larger than 0 and equal to or less than 10; $n_2$ represents an integer of 0 to 4; and $a_2$ represents 0 or 1.

[2] The heat-sensitive transfer image-receiving sheet as describe in the above item [1], wherein $R^4$ and $R^5$ in formula (A1) each independently represent a branched alkyl group having 4 to 10 carbon atoms.

[3] The heat-sensitive transfer image-receiving sheet as describe in the above item [1] or [2], wherein $a_1$ in the group represented by $R^2$ in formula (S1) is an integer of 30 or more.

Hereinafter, the present invention will be described in detail. In the present specification, "to" denotes a range including numerical values described before and after it as a minimum value and a maximum value.

[Heat-Sensitive Transfer Image-Receiving Sheet]

The heat-sensitive transfer image-receiving sheet of the present invention is explained in detail below.

The heat-sensitive transfer image-receiving sheet of the present invention (hereinafter also referred to as "the image-receiving sheet of the present invention") preferably has, on or above a support, at least one heat insulation layer (heat insulating layer), and at least one receptor layer.

According to a preferred embodiment of the present invention, the heat-sensitive transfer image-receiving sheet of the present invention is provided with a subbing layer between the support and the heat insulation layer, in order to impart various functions, for example, controlling of white background, prevention of static charge, adhesiveness, cushioning properties and smoothness to the image-receiving sheet.

Furthermore, according to another preferred embodiment of the present invention, the heat-sensitive transfer image-receiving sheet of the present invention is provided with an intermediate layer between the heat insulation layer and the receptor layer, in order to impart various functions, for example, controlling of white background, prevention of static charge, adhesiveness, cushioning properties and smoothness to the image-receiving sheet.

On the side of the support opposite to the receptor layer coating side, a curl adjusting layer, a writing layer, or a static adjusting layer may be disposed.

<Anionic Surfactant>

According to the present invention, the receptor layer on the support contains at least one anionic surfactant represented by the following formula (A1) or (A2). In order to greatly exhibit the effects of the present invention, a compound represented by the following formula (A1) in particular is more preferred.

Formula (A1)

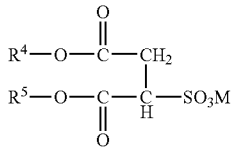

In formula (A1), $R^4$ and $R^5$ each independently represent an alkyl group having 3 to 20 carbon atoms, preferably an alkyl group having 4 to 10 carbon atoms, and more preferably a branched alkyl group having 4 to 10 carbon atoms. $R^4$ and $R^5$ each particularly preferably are a 2-ethylhexyl group.

In formula (A1), M represents a hydrogen atom or a cation. Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

Formula (A2)

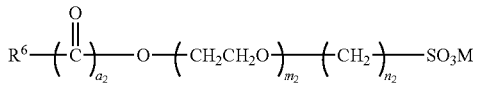

In formula (A2), $R^6$ represents an alkyl group or an alkenyl group, each having 6 to 20 carbon atoms; preferably an alkyl group or an alkenyl group, each having 10 to 20 carbon atoms;

and most preferably an alkyl group or an alkenyl group, each having 14 to 20 carbon atoms.

$R^6$ may represent a branched, alkyl or alkenyl group.

In formula (A2), M represents a hydrogen atom or a cation. Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

$m_2$ represents the average number of added moles, and is larger than 0 and equal to or less than 10. $m_2$ is more preferably 1 to 6, and most preferably 2 to 4.

$n_2$ represents an integer from 0 to 4, and is particularly preferably 2 to 4.

$a_2$ represents 0 or 1, and is particularly preferably 0.

Specific examples of the anionic surfactant are described below. However, the anionic surfactant that can be used in the present invention should not be construed as being limited to the below-described specific examples.

A1-1

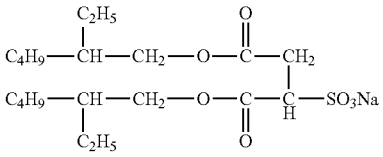

A1-2

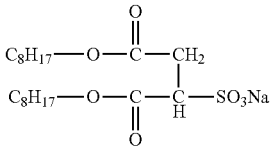

A1-3

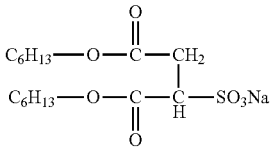

A1-4

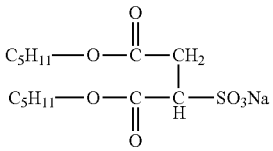

A1-5

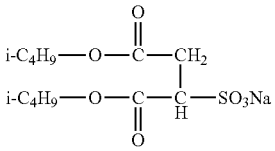

A1-6

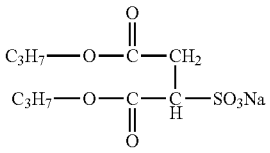

-continued

A1-7

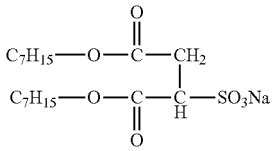

A1-8

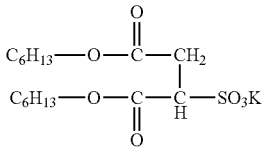

A1-9

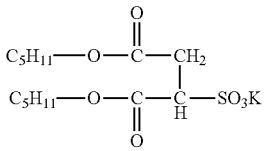

A1-10

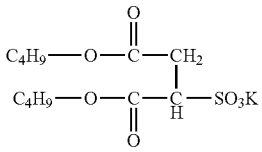

A2-1

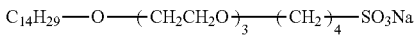

A2-2

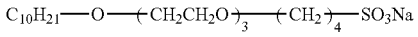

A2-3

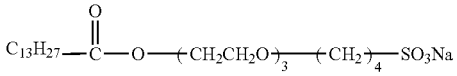

A2-4

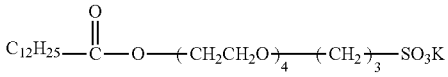

A2-5

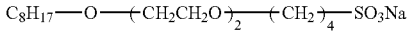

A2-6

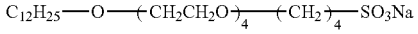

A2-7

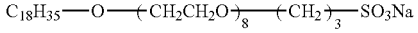

The anionic surfactant represented by formula (A1) and (A2) not only contributes to stabilization of the surface state by imparting wettability to the coating liquid, but also suppresses the generation of separation lines in the high-density image areas when used in combination with a polyether-modified silicone represented by formula (S1). The anionic surfactant also has an effect of preventing gloss unevenness.

The reflection gloss unevenness (hereinafter, also simply referred to as gloss unevenness) will be explained.

When an image is printed on a heat-sensitive transfer image-receiving sheet with a dye diffusion transfer recording type system, unevenness in the reflection gloss, which is recognized in the form of spots or islands, may occur in the black and high-density image areas.

Although the mechanism of gloss unevenness is not clearly known, but the phenomenon of gloss unevenness is speculated to generate as follows. At the time of high-density printing (200 to 450° C.), the trace amount of moisture present at the surface or within the heat-sensitive transfer image-receiving sheet rapidly vaporizes, and thereby a high pressure is applied locally on the surface, and the area under pressure is dented. Thus, minute surface unevenness is generated at the surface of the receptor layer. Subsequently, a heat transferable protective layer is transferred from the heat-sensitive transfer sheet to the printing area, and at this time, since a small amount of air enters into the interface between the heat transferable protective layer and the surface of the printing area, the gloss at the high density areas appears to be uneven.

The anionic surfactant represented by formulae (A1) and (A2) may be incorporated into any layer such as the heat insulation layer or the intermediate layer, in addition to the receptor layer.

The total coating amount of the anionic surfactant represented by formulae (A1) and (A2) is preferably from 5 mg/m$^2$ to 500 mg/m$^2$, and more preferably from 10 mg/m$^2$ to 200 mg/m$^2$.

Furthermore, according to the present invention, other various surfactants such as anionic, nonionic and cationic surfactants may also be used in combination in the receptor layer.

A preferred example of the other surfactants that may be used in combination with the anionic surfactant represented by formulae (A1) and (A2) is a fluorine-containing compound represented by the following formula (H).

Formula (H)

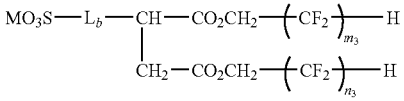

In the formula (H), $m_3$ and $n_3$ each independently represents an integer of 2 to 8, preferably 2 to 6, further preferably 3 to 6. The total value of $m_3$ and $n_3$ is preferably 6 or more to 12 or less, more preferably 6 or more to 10 or less. Among them, $m_3$ and $n_3$ are preferably the same, and most preferably m3 and n3 is 4.

Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

$L_b$ represents a single bond or an alkylene group. In a case where $L_b$ represents an alkylene group, the alkylene group is preferably an alkylene group having 2 or less carbon atoms, more preferably a methylene group. It is the most preferable that $L_b$ is a single bond.

It is preferable to combine the above preferable embodiments each other in the formula (H).

The specific examples of a compound represented by the formula (H) is described below. However, the compound represented by the formula (H) that can be used in the present invention is not limited thereto. In the following descriptions on the structure of the example compounds, unless particularly stated otherwise, the alkyl group and perfluoroalkyl group mean groups having a linear structure.

(H)-1

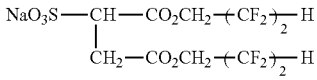

(H)-2

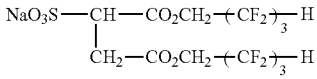

(H)-3

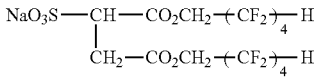

(H)-4

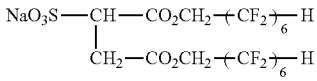

(H)-5

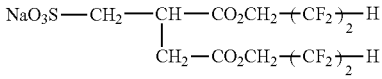

(H)-6

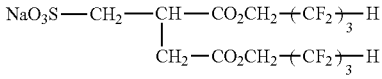

(H)-7

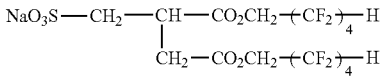

(H)-8

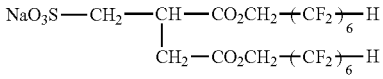

(H)-9

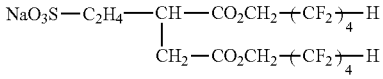

(H)-10

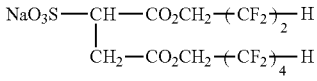

(H)-11

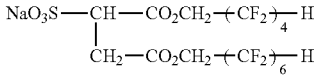

The coating amount of the fluorine-containing compound represented by the formula (H) is preferably from 0.5 mg/m$^2$ to 50 mg/m$^2$, and more preferably from 1 mg/m$^2$ to 20 mg/m2 with respect to the layer added with the compound.

<Receptor Layer>

The image-receiving sheet of the present invention has at least one receptor layer which contains at least a latex polymer and a polyether-modified silicone. The receptor layer plays a role of being dyed with a dye migrated from the heat-sensitive transfer sheet and maintaining a formed image.

(Latex Polymer)

In the image-receiving sheet of the present invention, the receptor layer contains a latex polymer.

In the present specification, the latex polymer is a dispersion in which water-insoluble hydrophobic polymers are dispersed as fine particles in a water-soluble dispersion medium. The dispersed state may be one in which spherical polymer-polymerized particles and/or a polymer are emulsified in a dispersion medium, one in which spherical polymer-polymerized particle polymer underwent emulsion polymerization, one in which spherical polymer-polymerized particles or polymer underwent micelle dispersion, one in which polymer molecules partially have a hydrophilic structure and thus the molecular chains themselves are dispersed in a molecular state, or the like. Among them, spherical polymer-polymerized particles are particularly preferable.

The receptor layer may also use, other than the latex polymer as a receptor polymer which receives the dye migrated from the heat-sensitive transfer sheet and thereby forms a recorded image at the time of heat-sensitive transfer, a latex polymer having the other functions in combination for the purpose of, for example, regulating the elastic modulus of a film.

The average particle diameter of the dispersed particles of the latex polymer used in the receptor layer is preferably 1 to 1,000 nm, particularly preferably 5 to 500 nm.

Examples of thermoplastic resins used in the latex polymer used in the receptor layer in the present invention include polycarbonates, polyesters, polyacrylates, vinyl chloride-series copolymers, polyurethane, styrene/acrylonitrile copolymers, polycaprolactone and the like.

Among them, polyesters, polyacrylates, and vinyl chloride-series copolymers are preferable, polyesters and vinyl chloride-series copolymers are particularly preferable, vinyl chloride-series copolymers are most preferable.

In the present specification, the vinyl chloride-series copolymer is a copolymer prepared with vinyl chloride as a polymerization monomer and other monomers, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

The copolymer may contain a unit derived from an auxiliary monomer component such as vinylalcohol derivatives, maleic acid derivatives, and vinyl ether derivatives.

It is preferable that the vinyl chloride-series copolymer used in the present invention contains vinyl chloride as a main component. The phrase "contain vinyl chloride as a main component" means that the vinyl chloride component is contained at a proportion of 50% by mole or more, and it is preferable that the vinyl chloride component is contained at a proportion of 50% by mole or more, while auxiliary monomer components such as a maleic acid derivative and a vinyl ether derivative are contained at a proportion of 10% by mole or less.

In the present invention, the latex polymers used in the receptor layer may be used singly or as a mixture of two or more thereof. The latex polymer used in the receptor layer may have a uniform structure or a core/shell structure, and in the latter case, the resins constituting the core and the shell, respectively, may have different glass transition temperatures.

In the present invention, the glass transition temperature (Tg) of the latex polymer used in the receptor layer is preferably −30° C. to 100° C., more preferably 0° C. to 90° C., further preferably 20° C. to 90° C., and further more preferably 40° C. to 90° C.

The glass transition temperature (Tg), if not practically measurable, may be calculated according to the following formula.

$$1/Tg=\Sigma(Xi/Tgi)$$

wherein, assuming that the polymer is a copolymer composed of n monomers from i=1 to i=n; Xi is a mass fraction of the i-th monomer ($\Sigma Xi=1$); Tgi is a glass transition temperature (measured in absolute temperature) of a homopolymer formed from the i-th monomer; and the symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The latex polymer preferably used in the present invention is such that the polymer concentration is preferably 10 to 70% by mass, and more preferably 20 to 60% by mass, based on the latex liquid. The total addition amount of the latex polymer in the receptor layer is such that the solid content of the latex polymer is preferably 50 to 98% by mass, and more preferably 70 to 95% by mass, based on the total amount of the polymer in the receptor layer.

As a preferable embodiment of the latex polymer, latex polymers such as acrylic-series polymers; polyesters; rubbers (e.g., SBR resins); polyurethanes; polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins; are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer used in the present invention is preferably exemplified by polyester latex, or any one of vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride-based copolymer latex include VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex). In the present invention, these are preferable latex polymers.

The latex polymer other than the vinyl chloride-based copolymer latex may include a polyester-based latex polymer. The polyester-based latex polymer is exemplified by Vylonal MD1200, Vylonal MD1220, Vylonal MD1245, Vylonal MD1250, Vylonal MD1500, Vylonal MD1930, Vylonal MD1985 (trade names, manufactured by Toyobo Co., Ltd.).

Even among these, vinyl chloride copolymer latexes such as a vinyl chloride/acrylic compound copolymer latex (particularly, a vinyl chloride/acrylic acid ester copolymer latex), a vinyl chloride/vinyl acetate copolymer latex, and a vinyl chloride/vinyl acetate/acrylic compound copolymer latex (particularly, a vinyl chloride/vinyl acetate/acrylic acid ester copolymer latex) are particularly preferred, and a vinyl chloride/acrylic compound copolymer latex is most preferred. It is also preferable to use the latexes in combination of two or more kinds.

(Water-Soluble Polymer)

The image-receiving sheet of the present invention may contain a water-soluble polymer in the receptor layer, and gelatin, polyvinyl alcohol, polyvinylpyrrolidone, and polyvinylpyrrolidone copolymers are preferably used. Among them, gelatin is preferably used, for the reason that gelatin has good settability at the time of coating. These water-soluble polymers are effective in controlling hydrophilicity and hydrophobicity of the receptor layer, and if the water-soluble polymer is used in a non-excessive amount, dye transfer from the ink sheet is well, and also, a good transfer density is obtained.

The amount of use of the water-soluble polymer is preferably 0.1 to 10% by mass, and more preferably 0.5 to 5% by mass, relative to the total mass of the solid content in the receptor layer.

(Polyether-Modified Silicone)

The image-receiving sheet of the present invention contains a polyether-modified silicone represented by the following formula (S1) in the receptor layer.

Formula (S1)

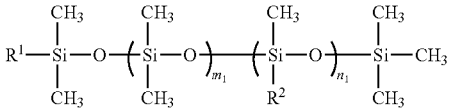

In formula (S1), $R^1$ represents an alkyl group; $R^2$ represents $—Y—(C_2H_4O)_{a1}—(C_3H_6O)_{b1}—R^3$; $R^3$ represents a hydrogen atom, an acyl group, a monovalent alkyl group, a monovalent cycloalkyl group, and a monovalent aryl group; X represents an alkylene group or an alkyleneoxy group; $m_1$ and $n_1$ each independently represent a positive integer; $a_1$ represents a positive integer; and $b_1$ represents 0 or a positive integer.

The alkyl group represented by $R^1$ may represent a branched alkyl group. The alkyl group represented by $R^1$ is preferably an alkyl group having 1 to 20 carbon atoms, more preferably 1 to 8 carbon atoms, still more preferably 1 to 4 carbon atoms. Among them, a methyl group and an ethyl group are preferable and a methyl group is most preferable.

The acyl group having an acyl moiety represented by $R^3$ includes, for example, an acetyl group, a propionyl group, a buthylyl group, and a benzoyl group. Among these acyl groups, an acyl group having 2 to 20 carbon atoms is preferable and an acyl group having 2 to 10 carbon atoms is more preferable.

The monovalent alkyl group represented by $R^3$ includes, for example, a methyl group, an ethyl group, a propyl group, an isopropyl group, a buthyl group, and a tert-buthyl group. The monovalent alkyl group is preferably a monovalent alkyl group having 1 to 20 carbon atoms, more preferably 1 to 10.

The monovalent cycloalkyl group represented by $R^3$ includes, for example, a cyclopenthyl group and a cyclohexyl group. The monovalent cycloalkyl group is preferably a monovalent cycloalkyl group having 5 to 10 carbon atoms.

The monovalent aryl group represented by $R^3$ includes, for example, a phenyl group and a naphthyl group. An aryl moiety of the monovalent aryl group is preferably a benzene ring.

$R^3$ preferably represents a monovalent alkyl group.

The divalent linking group represented by X is preferably an alkylene group and an alkyleneoxy group. The alkylene group preferably includes, for example, a methylene group, an ethylene group, and a propylene group. The alkyleneoxy group preferably includes, for example, $—CH_2CH_2O—$, $—CH(CH_3)CH_2O—$, $—CH_2CH(CH_3)O—$, and $—(CH_2)_3O—$. The divalent linking group X preferably has 1 to 4 carbon atoms and more preferably 2 or 3.

In addition, X preferably represents a single bond and the preferred divalent linking group.

The above $a_1$ is preferably an integer of 1 or larger, more preferably 1 to 200, and even more preferably 1 to 100. The above $b_1$ is preferably 0 or an integer of 1 or larger, more preferably 0 to 200, and even more preferably 0 to 100. Further, in order to exert more effectively the action of preventing separation lines in high-density image areas, which is an object of the present invention, it is more preferable that among the values of $a_1$ and $b_1$, $a_1$ is 30 or larger, and it is particularly preferable that both $a_1$ and $b_1$ are 30 or larger.

In order to more effectively exhibit the action of preventing separation lines in high-density image areas, which is an object of the present invention, $m_1$ is preferably 10 to 500, more preferably 30 to 300, and most preferably 50 to 200.

The above $n_1$ is preferably 1 to 50, and more preferably 1 to 20.

The polyether-modified silicone preferably has an average molecular weight of 55,000 or less, and more preferably 40,000 or less. The average molecular weight according to the present invention represents a mass average molecular weight. The mass average molecular weight used herein is a molecular weight value obtained by measuring a molecular weight with a GPC analyzer using columns of TSKgel GMHxL, TSKgel G4000HxL and TSKgel G2000HxL (trade names, manufactured by Tosoh Corporation) and then converting the measured value using polystyrene as a reference material; the solvent used for GPC analysis is THF and the detection is conducted by a differential refractometer.

It is preferable that the polyether-modified silicone is a liquid at 25° C.

The polyether-modified silicone is also such that the viscosity is preferably from 500 mPa·s to 10,000 mPa·s, more preferably from 1000 mPa·s to 5000 mPa·s, and even more preferably from 2000 mPa·s to 5000 mPa·s. The methods for viscosity measurement may be roughly classified into methods of measuring the resistance force exerted to a rotating body in the liquid, and methods of measuring the pressure loss occurring when the liquid is passed through an orifice or a capillary. The former methods involve rotary type viscometers, which are represented by a B type viscometer. The latter methods involve capillary viscometers, which are presented by an Ostwald viscometer. According to the present invention, the viscosity is defined as a value measured with a B type viscometer at a temperature of 25° C.

The HLB (Hydrophile-Lipophile-Balance) value of the polyether-modified silicone represented by formula (S1) is preferably 4.0 to 8.0, and particularly preferably 4.5 to 6.5. If the HLB value is too low, failure in the surface state is likely to occur. If the HLB value is too high, the ability of preventing the generation of separation lines is decreased.

In the present invention, the HLB value is determined by a calculation formula defined by the following expression based on the Griffin's method ("Kaimennkasseizaibinnrann (Handbook of Surfactants)," co-authored by Ichiro Nishi, Tooziro Imai and Masai Kasai, published by Sangyo Tosho Co., Ltd., 1960).

$$HLB=20\times Mw/M$$

Here, M represents the molecular weight, and Mw represents the formula weight (molecular weight) of the hydrophilic moiety. In addition, M=Mw+Mo, wherein Mo is the formula weight (molecular weight) of the lipophilic moiety. The hydrophilic moiety in this case is an ethyleneoxy group.

Specific examples of the polyether-modified silicone oil preferably used in the present invention include KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515, and X-22-6191, manufactured by Shin-Etsu Chemical Co., Ltd.; SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, and L-7002, manufactured by Dow Corning Toray Co., Ltd. (all trade names).

The polyether-modified silicone oil preferably used in the present invention can be easily synthesized by the methods described in, for example, JP-A-2002-179797, JP-A-2008-1896, and JP-A-2008-1897, or methods equivalent to these methods.

In the present invention, the polyether-modified silicone oil can be used singly, or in combination of two or more kinds thereof can also be used. Also, in the present invention, the other releasing agent may be used in combination with the polyether-modified silicone oil.

The addition amount of the polyether-modified silicone oil is preferably 1% by mass to 20% by mass, and more preferably 1% by mass to 10% by mass, based on the total amount of the latex polymer in the receptor layer.

The coating amount of the receptor layer in the present invention is preferably 0.5 to 10.0 g/m$^2$, and more preferably 0.5 to 5.0 g/m$^2$. The term "coating amount" in the present specification is a value calculated in terms of the solid contents, unless particularly stated otherwise.

<Heat Insulation Layer>

The heat-sensitive transfer image-receiving sheet of the present invention contains at least one heat insulation layer. The heat insulation may be a single layer or double or more multiple layers. The heat insulation layer is formed between the receptor layer and the support.

(Hollow Polymer Particle)

In the present invention, the heat insulation layer preferably contains hollow polymer particles.

The hollow polymer particles (hereinafter, also referred to as hollow particle) in the present invention are polymer particles having voids inside of the particles. The hollow polymer particles are preferably aqueous dispersion. Examples of the hollow polymer particles include (1) non-foaming type hollow particles obtained in the following manner: a dispersion medium such as water is contained inside of a capsule wall formed of a polystyrene, acrylic resin, styrene/acrylic resin or the like, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Of these, non-foaming hollow polymer particles of the foregoing (1) are preferred. If necessary, use can be made of a mixture of two or more kinds of hollow polymer particles. Specific examples of the above (1) include Rohpake HP-1055, manufactured by Rohm and Haas Co.; SX866(B), manufactured by JSR Corporation; and Nippol MH5055, manufactured by Nippon Zeon (all of these product names are trade names).

The average particle diameter (particle size) of the hollow particles is preferably 0.5 to 5.0 μm, more preferably 0.5 to 2.0 μm. If the average particle size of the hollow particles is not too small, the film can be designed to have high void ratio (porosity ratio) so that high heat insulation properties are obtained. If the average particle size of the hollow particles is not too large, collapse of the hollow particles due to film contraction during the drying step upon production does not occur easily.

The average particle diameter (size) of the hollow polymer particles used in the present invention is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof.

The hollow particles used in the present invention are such that the void ratio (hollow ratio) is preferably about 20 to 80%, and more preferably about 30 to 70%. If the hollow ratio is not too low, high heat insulation properties are obtained. On the other hand, if the hollow ratio is not too high, there occurs no decrease in the strength of the hollow particles, and collapse of the hollow particles due to film contraction during the drying step upon production does not occur easily.

The hollow ratio of the hollow particles used in the present invention can be determined by observing at least 300 hollow particles using a transmission electron microscope, computing the average circle-equivalent diameter of the outer diameters (R1) and the average circle-equivalent diameter of the inner diameters (R2), and calculating the volume ratio of the void portion to the particle volume, $(R2/R1)^3 \times 100$.

The glass transition temperature (Tg) of the hollow particles is preferably 70° C. or more and 200° C. or less, more preferably 90° C. or more and 180° C. or less. As the hollow particles, it is particularly preferable to use a hollow polymer particle latex such as a latex polymer having hollow particles dispersed in water.

In the image-receiving sheet of the present invention, the ratio of the total volume of the hollow particles occupying in the total volume of the heat insulation layer is preferably 30% to 90%, and more preferably 50% to 80%.

The ratio of the total solid content of the hollow particles occupying in the total solid content of the heat insulation layer is preferably 20% by mass to 80% by mass, and more preferably 30% by mass to 70% by mass.

In the present invention, when there are two or more heat insulation layers, for example, it is preferable embodiment that the heat insulation layers is divided into an upper heat insulation layer and a lower heat insulation layer.

(Gelatin)

In the present invention, it is preferable that the heat insulation layer contains gelatin. The gelatin used in the present invention may be any of a so-called alkali-treated (lime-treated) gelatin obtained by immersing gelatin in an alkali bath, an acid-treated gelatin obtained by immersing gelatin in an acid bath, a double-immersed gelatin obtained by immersing gelatin in both of an alkali bath and an acid bath before gelatin extraction during the production process, and an enzyme-treated gelatin. Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

(Water-Soluble Polymer Other than Gelatin)

In the present invention, the heat insulation layer may contain water-soluble polymers other than gelatin. The water-soluble polymer which can be used in the present invention other than gelatin includes natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention.

Among the water-soluble polymers, other than gelatin, which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers, other than gelatin, which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.). Among them, polyvinyl alcohols are preferably used.

The polyvinyl alcohol used in the present invention includes, for example, PVA-105, PVA-110, PVA-117, PVA-120, PVA-124, PVA-203, PVA-204, PVA-205, PVA-210, PVA-217, PVA-220, PVA-224, PVA-228, PVA-235, PVA-403, and PVA-405 (all trade names, manufactured by KURARAY CO., LTD).

Among the preferred water-soluble polymers mentioned above, it is preferable to use polyvinyl alcohol or gelatin. These polymers can be used singly or in the mixture thereof, and more preferably, gelatin is used.

(Latex Containing Styrene-Butadiene Copolymer)

According to the present invention, it is preferable that the heat insulation layer contains a latex containing a styrene-butadiene copolymer, and it is particularly preferable that the heat insulation layer contains a latex containing a styrene-butadiene copolymer which has a glass transition temperature of 30 to 85° C. Here, the styrene-butadiene copolymer means a polymer containing repeating units of styrene and butadiene in the polymer molecular chain.

The latex containing a styrene-butadiene copolymer having a Tg of 30 to 85° C. is superior from the viewpoint of being capable of forming a heat insulation layer which is not easily affected by pressure, as compared with latexes of polymers other than the styrene-butadiene copolymer having a Tg of 30 to 85° C.

The glass transition temperature (Tg) can be measured according to the method stipulated in JIS K7121 using a differential scanning calorimeter.

The styrene-butadiene copolymer is such that the number average molecular weight is preferably 2,000 to 1,000,000, and more preferably 5,000 to 500,000.

Regarding the styrene-butadiene copolymer, the molar ratio of the monomers constituting the repeating units is such that the ratio of styrene:butadiene is preferably 99:1 to 40:60, and more preferably 95:5 to 50:50.

The styrene-butadiene copolymer also includes those which have been modified with a carboxyl group or the like.

Furthermore, the styrene-butadiene copolymer may contain a copolymerization component other than the repeating units of styrene and butadiene, and for example, acrylonitrile, acrylic acid, methacrylic acid, or alkyl acrylate or alkyl methacrylate such as methyl methacrylate or ethyl acrylate may be copolymerized thereinto. When the styrene-butadiene copolymer contains a component other than styrene and butadiene, it is preferable that the total proportion of the styrene component and the butadiene component is 50% by mass or more.

The styrene-butadiene copolymer may be a random copolymer or a block copolymer. The styrene-butadiene copolymer may be a straight-chained polymer or a branched polymer, or may be a polymer having a crosslinked structure.

The average particle size of the latex of styrene-butadiene copolymer is preferably 50 nm to 500 nm, and more preferably 50 nm to 300 nm.

In regard to the latex containing a styrene-butadiene copolymer, commercially available products may be used, and examples include Nipol LX433C, 2507H, LX407BP6, V1004 (manufactured by ZEON CORPORATION), Nalstar SR-115, SR-143 (manufactured by NIPPON A & L INC.), and PCL0602 (manufactured by JSR Corporation).

According to the present invention, the mass ratio of the solid content of gelatin a and the solid content of the latex b in the heat insulation layer (solid mass content of gelatin/solid mass content of the latex containing a styrene-butadiene copolymer, that is, a/b) is preferably 30/70 to 70/30, and more preferably 40/60 to 60/40.

When the sum of the solid mass contents of gelatin and the latex containing a styrene-butadiene copolymer contained in the heat insulation layer is designated as A, and the solid mass content of the hollow particles as B, the ratio B/A is preferably 30/70 to 70/30, and more preferably 40/60 to 60/40. If the heat insulation layer contains a water-soluble polymer other than gelatin, the solid mass content of the water-soluble polymer is also added to A. When A is not so large, the porosity in the heat insulation layer is sufficiently maintained, and thus it is easy to secure sufficient heat insulation properties. When A is not so small, brittleness of the film is satisfactory.

The thickness of the heat insulation layer is preferably 5 to 40 μm, and more preferably 10 to 30 μm. If the thickness is too small, it is difficult to obtain desired heat insulation properties, and if the thickness is too large, a large production load is required for gelling the coating liquid to dry.

<Intermediate Layer>

The heat-sensitive transfer image-receiving sheet of the present invention may have at least one intermediate layer between the heat insulation layer and the receptor layer. The intermediate layer is a layer that is appropriately provided, for example, for the purpose of imparting adhesiveness to the upper and lower layers, or for the purpose of imparting cushioning properties to the image-receiving sheet.

It is particularly preferable that the intermediate layer of the heat-sensitive transfer image-receiving sheet of the present invention contains a latex polymer.

The latex polymer is not particularly limited, but the latex polymer is selected from latex polymers, for example, a polyurethane, a styrene-butadiene copolymer (SBR latex), an acrylonitrile-butadiene copolymer (NBR latex), a methyl methacrylate-butadiene copolymer (MBR latex), a styrene-acrylic copolymer, a polyacrylic acid ester, a polymethacrylic acid ester, a polymethacrylic acid ester, polyvinyl acetate, a vinyl chloride-vinyl acetate copolymer, an ethylene-vinyl acetate copolymer, a styrene-butadiene-acrylic copolymer, a polyvinylidene chloride, and a vinyl chloride-(meth)acrylic acid ester copolymer. Among these, polyurethane, SBR, NBR, MBR and a vinyl chloride/(meth)acrylic acid ester are preferred, SBR and a vinyl chloride-(meth)acrylic acid ester copolymer are more preferred, SBR is most preferred. These latex polymers can be used singly or as mixtures of two or more kinds thereof according to necessity.

Examples of polyurethane-series latex include HYDRAN AP10, AP20, AP30, AP40, APX-101H, 1320NS, 1610NS, 1670NS, 1980NS, HW-337, HW-350, HW-920, and HW-940, manufactured by DIC Corporation; WEM-202U, WEM-3008, WEM-321U, WEM-031U, WBR-016U, WBR-2018U, and WBR-2019, manufactured by TAISEI FINE CHEMICAL CO., LTD; D-1000, D-2000, D-4000, D-6000, and D-9000, manufactured by Dainichiseika Color & Chemicals Mfg. Co., Ltd; NS-155NX, NS-310A, NS-310X, and NS-311X, manufactured by Takamatsu Oil & Fat Co., Ltd; WOE-305 manufactured by Nippon Polyurethane Industry Co., Ltd; Elastron manufactured by Dai-ichi Kogyo Seiyaku Co., Ltd (all trade names).

Examples of methylmethacrylate-butadiene latex copolymers include MR-170, MR-171, MR-172, MR-173, MR-174, and MR-180 manufactured by Nippon A & L Inc. (all trade names).

Examples of acrylonitrile-butadiene latex copolymers include SR-141 and SR-142 manufactured by Nippon A & L Inc.; Nipol 1561, 1562, 1571H, 1571C2, 1571CL, LX517A, LX517B, 1577K, LX511A, LX513, LX531, LX531B, LX550, LX550L, LX551, and LX552 manufactured by Zeon Corporation (all trade names).

Examples of the vinyl chloride-(meth)acrylic acid ester copolymer include the vinyl chloride and vinyl chloride copolymer latexes explained previously for the receptor layer.

In the present invention, the intermediate layer may contain a water-soluble polymer. Example of the water-soluble polymers may include the water-soluble polymers described in the section <Heat insulation layer>. Among these water-soluble polymers, polyvinyl alcohol is particularly preferred. These resins can be used singly or in the mixture thereof.

The coating amount of the intermediate layer used in the present invention is preferably 0.5 to 10.0 g/m$^2$ and more preferably 1.0 to 5.0 g/m$^2$.

<Subbing Layer>

The heat-sensitive transfer image-receiving sheet of the present invention may have a subbing layer between the support and the heat insulation layer. The subbing layer is a layer that is appropriately provided, for example, for the purpose of imparting adhesiveness to the upper and lower layers, or for the purpose of imparting cushioning properties to the image-receiving sheet. The subbing layer is distinguished from the undercoat layer that is coated preliminarily on the support. A preferred embodiment of the subbing layer is the same as described in the section <Intermediate layer>, and the constitutions of the subbing layer and the intermediate layer may be identical or different from each other.

The coating amount of the subbing layer used in the present invention is preferably 0.5 to 10.0 g/m$^2$ and more preferably 1.0 to 5.0 g/m$^2$.

Other than the above layers, for example, a white background controlling layer, a charge controlling layer, an adhesive layer, and a primer layer may be formed. These layers may be formed in the same manner as those described in, for example, each specification of Japanese Patent Nos. 3585599 and 2925244.

<Support>

As the support that is used for the heat-sensitive transfer image-receiving sheet of the present invention, there may be used typical supports with a preferable example being a water-proof support. The use of the waterproof support makes it possible to prevent the support from absorbing moisture, whereby a fluctuation in the performance of the receptor layer with the lapse of time can be prevented. As the waterproof support, for example, coated paper, laminate paper or synthetic paper may be used. Among them, laminate paper is preferable. It is conventional that an undercoat layer is coated on the support.

<Curling Control Layer>

It is preferable to form a curling control layer on the heat-sensitive transfer image-receiving sheet of the present invention, according to the necessity. For the curling control layer, a polyethylene laminate, a polypropylene laminate or the like is used. Specifically, the curling control layer may be formed in a manner similar to those described in, for example, JP-A-61-110135 and JP-A-6-202295.

<Writing Layer and Charge Controlling Layer>

A writing layer and a charge controlling layer may be provided on the heat-sensitive transfer image-receiving sheet of the present invention, according to the necessity. For the writing layer and the charge controlling layer, an inorganic oxide colloid, an ionic polymer, or the like may be used. As an antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge controlling layer may be formed in a manner similar to those described in the specification of Japanese Patent No. 3585585.

<Other Additives>

The heat-sensitive transfer image-receiving sheet of the present invention may also contain additives in layers other than the receptor layer, if necessary. Examples of these additives that can be incorporated include, an ultraviolet absorbent, a surfactant, an antiseptic agent, a film-forming aid, a film-hardening agent, a matting agent (including a lubricating agent), an oxidation inhibitor, and other additives.

(Ultraviolet Absorbent)

The heat-sensitive transfer image-receiving sheet of the present invention may contain any ultraviolet absorbents. As the ultraviolet absorbents, use can be made of typical inorganic or organic ultraviolet absorbents. As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting. In addition, disclosed is a method of obtaining ultraviolet-shielding resins by the steps of dissolving ultraviolet absorbents in a monomer or oligomer of the resin to be used, and then polymerizing the monomer or oligomer (JP-A-2006-21333). In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitation.

Examples of commercially available ultraviolet absorbents include TINUVIN-P (trade name, manufactured by Ciba-Geigy), JF-77 (trade name, manufactured by JOHOKU CHEMICAL Co., Ltd.), SEESORB 701 (trade name, manufactured by SHIRAISHI CALCIUM KAISHA, Ltd.), SUMISORB 200 (trade name, manufactured by Sumitomo Chemical Co., Ltd.), VIOSORB 520 (trade name, manufactured by KYODO CHEMICAL Co., Ltd.), and ADKSTAB LA-32 (trade name, manufactured by ADEKA).

<Antiseptic>

To the heat-sensitive transfer image-receiving sheet of the present invention, antiseptics may be added. The antiseptics that may be contained in the image-receiving sheet of the present invention are not particularly limited. For example, use can be made of materials described in Bofubokabi (Preservation and Antifungi) HAND BOOK, Gihodo shuppan (1986), Bokin Bokabi no Kagaku (Chemistry of Anti-bacteria and Anti-fungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

(Film-Forming Aid)

It is preferable to add a high boiling point solvent to the heat-sensitive transfer image-receiving sheet of the present invention. The high boiling point solvent is an organic compound (typically, an organic solvent) which functions as a film-forming aid or a plasticizer, and lowers the lowest film-forming temperature of the latex polymer, and such solvents are described in, for example, "Gosei Latex no Kagaku (Chemistry of Synthetic Latex)", Soichi Muroi, issued by Kobunshi Kanko Kai (1970). Examples of the high boiling point solvent (film-forming aid) include the following compounds.

Z-1: Benzyl alcohols

Z-2: 2,2,4-Trimethylpentanediol-1,3-monoisobutyrates

Z-3: 2-Dimethylaminoethanols

Z-4: Diethylene glycols

When these high boiling point solvents are added to the image-receiving sheet, spread of image is observed, and it is not preferable for practical use. However, if the content of the solvent in the coating film is not too large, there is no problem in terms of performance.

<Hardening Agent>

The heat-sensitive transfer image-receiving sheet of the present invention may contain a hardening agent (hardener). The hardening agent may be added to a coated layer such as a receptor layer, a heat insulation layer, and a subbing layer of the heat-sensitive transfer image-receiving sheet.

Preferable examples of the hardener that can be used in the present invention include H-1, 4, 6, 8, and 14 in JP-A-1-214845 in page 17; compounds (H-1 to H-54) represented by formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in Claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido)ethane, etc.), an N-methylol-series hardening agent (dimethylol urea, etc.), a boric acid, a metaboric acid, or a polymer hardening agent (compounds described, for example, in JP-A-62-234157), can be mentioned. Preferable examples of the hardener include a vinyl sulfone-series hardener and chlorotriazines.

<Matting Agent>

To the heat-sensitive transfer image-receiving sheet of the present invention, a matting agent may be added in order to prevent blocking, or to give a release property or a sliding (lubricating) property. In the image-receiving layer, the matting agent may be added on the same side as the coating side of the receptor layer, or on the side opposite to the coating side of the receptor layer, or on both sides.

Examples of the matting agent generally include fine particles of water-insoluble organic compounds and fine particles of water-insoluble inorganic compounds. In the present invention, the organic compound-containing fine particles are preferably used from the viewpoints of dispersion properties. In so far as the organic compound is incorporated in the particles, there may be organic compound particles consisting of the organic compound singly, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

(Preparation Method of Heat-Sensitive Transfer Image-Receiving Sheet)

The heat-sensitive transfer image-receiving sheet of the present invention is explained below.

The heat-sensitive transfer image-receiving sheet of the present invention has at least one heat insulation layer and at least one receptor layer, and may appropriately have an intermediate layer between the heat insulation layer and the receptor layer. It is preferable to carry out the preparation method such that the respective coating liquids for the layers are coated by simultaneous multi-layer coating on the support.

Such the simultaneous multi-layer coating is preferably an aqueous type coating. The so-called "aqueous type" here means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

It is known that in the case of producing an image-receiving sheet composed of plural layers having different functions from each other (for example, a heat insulation layer, an intermediate layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent publication); and Edgar B. Gutoff, et al., "Coating and Drying Defects: Troubleshooting Operating Problems", John Wiley & Sons Company, 1995, pp. 101-103. In these coating methods, a plurality of coating liquids is simultaneously supplied to the coating apparatus, thereby to form a plurality of layers different in kinds.

As the method for producing the heat-sensitive transfer image-receiving sheet of the present invention, simultaneous multiple-layer coating can be carried out, and from the viewpoint of being capable of realizing high productivity, slide coating or curtain coating is preferred. The heat-sensitive transfer image-receiving sheet of the present invention is generally produced by coating at least one receptor layer and at least one heat insulation layer, on a support by water-based coating. In the case where those layers are respectively constituted of multiple layers, or in the case where the heat-sensitive transfer image-receiving sheet has an intermediate layer or a subbing layer, it is preferable to simultaneously coat all of the layers, including the intermediate layer and the subbing layer, on the support.

In regard to the simultaneous multiple-layer coating, it is necessary to adjust the viscosity and surface tension of the coating liquids to form the respective layers, from the viewpoint of uniform coated layer formation and satisfactory coatability. The viscosity of the coating liquid can be readily adjusted by using a usual thickening agent or thinning agent to the extent that these agents do not affect other performances. Further, the surface tension of the coating liquid can be adjusted by means of various surfactants.

The temperature of these coating liquids for coating various layers is preferably 25° C. to 60° C., and more preferably 30° C. to 50° C. Particularly, the temperature of the coating liquids in the case of using gelatin in the coating liquid is preferably 33° C. to 45° C.

The coated amount of the coating liquid for a layer that constructs the multilayer constitution according to the present invention is preferably in the range of 1 g/m$^2$ to 500 g/m$^2$. The number of layers in the multilayer constitution can be arbitrarily selected to be two or more. It is preferable that the receptor layer is provided as a layer disposed farthest from the support.

In the drying zone, drying proceeds through: the constant rate period of drying, in which the drying rate is constant, and the material temperature is approximately equal to the wet-bulb temperature; and a falling rate period of drying, in which the drying rate are slowed, and the material temperature rises. In the constant rate drying period, any heat supplied from an external source is all used in the evaporation of moisture. In the falling rate drying period, moisture diffusion inside the material becomes rate-limiting, and the drying rate is lowered due to recession of the evaporation surface or the like. The supplied heat is used in the rising of the material temperature.

In the setting zone and drying zone, moisture migration occurs between the respective coated films (coated layers) and between the support and the coated films, and solidification also occurs due to cooling of the coated films and moisture evaporation. For those reasons, the quality and performance of the resultant product is greatly influenced by the processing history, such as the layer surface temperature during drying and the drying period of time, and it is required to set the conditions in accordance with the demanded quality.

The temperature of the setting zone is generally 15° C. or below, and it is preferable to set the cooling step time period in the range from not less than 5 seconds to less than 30 seconds. If the cooling time period is too short, a sufficient increase of the coating liquid viscosity cannot be obtained, and the surface state is deteriorated upon the subsequent drying step. On the other hand, if the cooling time period is too long, the removal of moisture in the subsequent drying step takes time, and the production efficiency is decreased.

After the cooling step generally at 15° C. or below, drying is carried out in an environment generally at above 15° C. In that case, according to the present invention, it is preferable to adjust the amount of evaporation of water in the coated films that have been coated in multiple layers within 30 seconds after the completion of cooling, to 60% or more of the amount of moisture contained at the layer surface smeared per an area of 1 m$^2$ immediately after coating. The terms "amount of moisture contained at the layer surface smeared per an area of 1 m$^2$ immediately after coating", is equal to the water content in the coating liquid prepared before the coating. When the amount of evaporating moisture is not so small, moisture is present on the coated surface not in excess, and the surface state is satisfactory. On the other hand, in the case of adjusting the amount of evaporation to 60% or more, when the drying temperature is brought to a temperature not so higher than 50° C., the evaporation of moisture does not occur rapidly, without causing cracking or the like, and the surface state is satisfactory. Thus, it is preferable to control the drying temperature to 50° C. or below.

Determination of the amount of evaporation can be carried out such that the mass obtained by drying the heat-sensitive transfer image-receiving sheet after coating under the conditions (in an atmosphere) of 110° C. for one hour, is defined as the mass after 100% evaporation, and the difference between the masses before and after drying are measured.

The coating-finished product which has been dried is adjusted to have a certain water content, followed by winding up. Since the progress of film hardening is affected by the water content and temperature during the storage of the wound, coating-finished product, it is necessary to set the conditions for humidification step that are appropriate for the water content in a wound-up state.

In general, the film-hardening reaction can be carried out more easily at higher temperature and higher humidity conditions. However, if the water content is too high, adhesion between the coated products may occur, or there may be a problem in terms of performance. For this reason, it is necessary to set the water content in the wound-up state (humidification conditions) and the storage conditions in accordance with the product quality.

Typical drying devices include an air-loop system and a helical system. The air-loop system is a system in which drying blasts are made to blow on a coated product supported by rollers, and wherein a duct may be mounted either longitudinally or transversely. Such a system has a high degree of freedom in setting of the volume of drying wind, because a drying function and a transporting function are basically separated therein. However, many rollers are used therein, so base-transporting failures, such as gathering, wrinkling and slipping, tend to occur. The helical system is a system in which a coated product is wound round a cylindrical duct in a helical fashion, and transported and dried as it is floated by drying wind (air floating). So no support by rollers is basically required (JP-B-43-20438). In addition to those, there is available a drying system which conveys by reciprocally installing upper and lower ducts and conveying the coated product. In general, this system has a better dryness distribution than that of the helical system, but is poor in floatability.

(Image-Forming Method)

As an image-forming method (system) using the heat-sensitive transfer image-receiving sheet of the present invention, an image is formed by superposing a heat-sensitive transfer sheet on the heat-sensitive transfer image-receiving sheet of the present invention so that a dye layer (heat transfer layer) of the heat-sensitive transfer sheet is in contact with a receptor layer of the heat-sensitive transfer image-receiving sheet and applying thermal energy to the sheets in accordance with image signals from a thermal head.

Specifically, image-forming can be conducted by the same manner as that described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 2.0 msec/line or less, and more preferably 1.5 msec/line or less, still more preferably 0.73 msec/line or less, most preferably 0.65 msec/line or less. Further, from the viewpoint of improvement in transfer efficiency as one of speeding-up conditions, the highest ultimate temperature of the thermal head at the time of printing is preferably in the range of from 180° C. to 450° C., more preferably from 200° C. to 450° C., and furthermore preferably from 350° C. to 450° C.

The heat-sensitive transfer image-receiving sheet of the present invention may be utilized for printers, copying machines and the like, which employ a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (trade name: Video Printer VY-100, manufactured by Hitachi, Ltd.), sufficiently attains the expected result. Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

(Heat-Sensitive Transfer Sheet)

The heat-sensitive transfer sheet is a sheet provided, on a support such as polyethylene terephthalate (PET), with coloring material layers formed by dispersing coloring materials of three colors: yellow, magenta and cyan, respectively, in a binder resin, and a transferable protective layer in area order. The coloring material layers may also be composed of layers of four colors, including black.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

(Binder Resin)

Examples of the binder resins used in the heat-sensitive transfer sheet include acrylic resins such as polyacrylonitrile, polyacrylate, and polyacrylamide; polyvinyl acetal-series resins such as polyvinyl acetoacetal, and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. These may be used singly, or two or more thereof may be used in the form of a mixture or copolymer.

(Dye)

The dye used in the present invention is not limited, as long as it is able to diffuse by heat and able to be incorporated in a heat-sensitive transfer sheet, and able to transfer by heat from the heat-sensitive transfer sheet to an image-receiving sheet. As the dye used for a heat transfer sheet (heat-sensitive transfer sheet), ordinarily used dyes or known dyes can be effectively used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of a yellow dye that can be used in the present invention include Disperse Yellow 231, Disperse Yellow 201 and Solvent Yellow 93. Specific examples of a magenta dye that can be used in the present invention include Disperse Violet 26, Disperse Red 60, and Solvent Red 19. Specific examples of a cyan dye that can be used in the present invention include Solvent Blue 63, Solvent Blue 36, Disperse Blue 354 and Disperse Blue 35. As a matter of course, it is also possible to use suitable dyes other than these dyes as exemplified above. Further, dyes each having a different hue from each other as described above may be arbitrarily combined together.

(Heat Transferable Protective Layer (Laminate))

A heat transferable protective layer (laminate) is used for forming a protective layer composed of a transparent resin on a thermally transferred image by thermal transfer and thus covering and protecting the image, thereby to improve durability such as scratch resistance, light-fastness, and resistance to weather. Such the transparent protective layer (heat transferable protective layer (laminate)) is preferably formed in the case where the dye transferred on the image-receiving sheet is insufficient in image durabilities such as light resistance, scratch resistance, and chemical resistance in the state that the dye is naked in the surface of the image-receiving sheet. As an example, the transferable protective layer laminate can be formed by forming, onto a PET support, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use the support on which an easy adhesive layer has already been formed.

As a resin forming the protective layer, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are conventionally known as a resin for forming the protective layer. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

The use of the above-described ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. At this moment, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that the protective layer contains ultraviolet-absorbing agents and/or ultraviolet-shielding resins in order to give light-fastness to the printed matter.

Although characteristics of the protective layer vary depending on the kind of protective layer-forming resin, the protective layer is formed by the same method as the method of forming the above-described dye layer. A thickness of the protective layer is preferably in the range of from about 0.5 μm to about 10 μm.

According to the present invention, there can be provided a high quality heat-sensitive transfer image-receiving sheet, which maintains a coated surface in a good state, is suitable for high-speed printing, has a high value in the highest density, and hardly causes gloss unevenness in the high-density image areas.

The present invention will be described in more detail based on the following examples, but the invention is not intended to be limited thereto.

EXAMPLES

The present invention will be described in more detail based on the following examples. Any materials, reagents, amount and ratio of use and operations, as shown in the examples, may appropriately be modified without departing from the spirit and scope of the present invention. It is therefore understood that the present invention is by no means intended to be limited to the specific examples below. In the following Examples, the terms "part" and "%" with respect to the composition are values by mass, unless they are indicated differently in particular.

Synthesis Example of Polyether-Modified Silicone

Synthesis of the polyether-modified silicone represented by formula (S1) used in the present invention can be carried out using the known methods described in Kunio Itoh, "Silicone Handbook" (Nikkan Kogyo Shimbun Co., Ltd., 1990, p. 163) and the like.

Specifically, in a glass flask equipped with a stirring device and a thermometer, 20 parts by mass of a dimethylsiloxane-methyl hydrogen siloxane copolymer represented by the average structural formula (1):

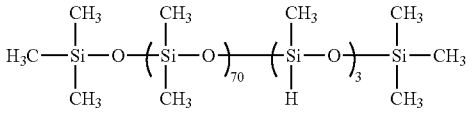

and 40 parts by mass of single-terminal allyl etherified polyoxyalkylene represented by the average structural formula (2): $CH_2{=}CHCH_2O(C_2H_4O)_{20}(C_3H_6O)_{20}CH_3$ were mixed, and 20 parts by mass of isopropyl alcohol was added as a solvent. Furthermore, chloroplatinic acid was added thereto. After the mixture was stirred for 2 hours at 86° C., it was confirmed that the peak representing Si—H in the infrared absorption spectrum disappeared. The mixture was stirred for another 30 minutes. The reaction liquid was concentrated under reduced pressure, and thereby a polyether-modified silicone S1-1 shown in Table 1 below was obtained.

Polyether-modified silicone S1-2 shown in Table 1 below was obtained in the same manner as in Synthesis Example of polyether-modified silicone S1-1, except that the structure of the single-terminal allyl etherified polyoxyalkylene was changed to the average structural formula (3): $CH_2{=}CHCH_2O(C_2H_4O)_{35}CH_3$.

Polyether-modified silicone S1-3 shown in Table 1 below was obtained in the same manner as in Synthesis Example of polyether-modified silicone S1-1, except that the structure of the single-terminal allyl etherified polyoxyalkylene was changed to the average structural formula (4): $CH_2{=}CHCH_2O(C_2H_4O)_{10}CH_3$.

Polyether-modified silicone S1-4 shown in Table 1 below was obtained in the same manner as in Synthesis Example of polyether-modified silicone S1-1, except that the structure of the single-terminal allyl etherified polyoxyalkylene was changed to the average structural formula (5): $CH_2{=}CHCH_2O(C_2H_4O)_{50}(C_3H_6O)_{50}CH_3$.

Polyether-modified silicone S1-5 shown in Table 1 below was obtained in the same manner as in Synthesis Example of polyether-modified silicone S1-1, except that the structure of the single-terminal allyl etherified polyoxyalkylene was changed to the average structural formula (6): $CH_2{=}CHCH_2O(C_2H_4O)_{40}(C_3H_6O)_{35}CH_3$.

TABLE 1

| Polyether-modified silicone | a1 | b1 |
|---|---|---|
| Polyether-modified silicone S1-1 | 20 | 20 |
| Polyether-modified silicone S1-2 | 35 | 0 |
| Polyether-modified silicone S1-3 | 10 | 0 |
| Polyether-modified silicone S1-4 | 50 | 50 |
| Polyether-modified silicone S1-5 | 40 | 35 |

(Preparation of Sample 101)

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the intermediate layer and the receptor layer each having the following composition were simultaneously multilayer-coated on the gelatin undercoat layer, in the state that the subbing layer, the heat insulation layer, the intermediate layer and the receptor layer were laminated in this order from the side of the support, by a method illustrated in FIG. 9 in U.S. Pat. No. 2,761,791, to prepare Sample 101. The coating was performed so that solid contents of the subbing layer, the heat insulation layer, the intermediate layer, and the receptor layer after drying would be 3 g/m$^2$, 15 g/m$^2$, 2.5 g/m$^2$ and 2.5 g/m$^2$, respectively.

In this case, assuming continuous production, coating liquids for the above layers were simultaneously multilayer-coated after aging for 24 hours at 40° C.

Coating Liquid for Receptor Layer 1:

| | |
|---|---|
| Vinyl chloride/acrylic copolymer latex (trade name: Vinybran 900, manufactured by Nissin Chemical Industry Co., Ltd., solid content: 40%, vinyl chloride/acrylic ester copolymer) | 20.0 mass parts |
| Vinyl chloride/acrylic copolymer latex (trade name: Vinybran 690, manufactured by Nissin Chemical Industry Co., Ltd., solid content: 55%, vinyl chloride/acrylic ester copolymer) | 20.0 mass parts |

-continued

| | |
|---|---|
| Gelatin (10% aqueous solution) | 2.0 mass parts |
| Polyvinylpyrrolidone (trade name: K-90, manufactured by ISP Japan Ltd.) | 0.5 mass part |
| Silicone releasing agent having both terminals modified with polyether (solid) (trade name: KF-6004, manufactured by Shin-Etsu Chemical Co., Ltd.) | 1.5 mass parts |
| Water | 50.0 mass parts |

Coating Liquid for Intermediate 1:

| | |
|---|---|
| Vinyl chloride/acrylic copolymer latex (trade name: Vinybran 690, manufactured by Nissin Chemical Industry Co., Ltd., solid content: 55%) | 50.0 mass parts |
| Gelatin (10% aqueous solution) | 30.0 mass parts |
| Water | 20.0 mass parts |

Coating Liquid for Heat Insulation Layer 1:

| | |
|---|---|
| Acrylic hollow polymer particles (trade name: Rohpake HP-1055, average particle diameter: 1.0 μm, solid content: 26.5%, hollow ratio: 55%, manufactured by Rohm and Haas Co.) | 20.0 mass parts |
| Acrylic/styrene based hollow polymer particles (trade name: Nipol MH5055, average particle diameter: 0.5 μm, solid content: 30%, hollow ratio: 55%, manufactured by ZEON CORPORATION) | 3.0 mass parts |
| Gelatin (10% aqueous solution) | 25.0 mass parts |
| Styrene-butadiene latex (trade name: Nipol LX407BP6, Tg = 70° C., solid content: 50%, manufactured by ZEON CORPORATION) | 5.0 mass parts |
| Water | 47.0 mass parts |

Coating Liquid for Subbing Layer 1:

| | |
|---|---|
| Polyvinyl alcohol (trade name: POVAL PVA235, manufactured by Kuraray) | 2.5 mass parts |
| Styrene butadiene rubber latex (trade name: SN-307, manufactured by NIPPON A & L INC., solid content: 48%) | 30.0 mass parts |
| Water | 65.0 mass parts |

(Preparation of Sample 102)

Sample 102 was prepared in the same manner as sample 101, except that the coating liquid for receptor layer 1 for sample 101 was changed to the following coating liquid for receptor layer 2.

(Composition)

Coating Liquid for Receptor Layer 2:

| | |
|---|---|
| Vinyl chloride/acrylic copolymer latex (trade name: Vinybran 900, manufactured by Nissin Chemical Industry Co., Ltd., solid content: 40%) | 20.0 mass parts |
| Vinyl chloride/acrylic copolymer latex (trade name: Vinybran 690, manufactured by Nissin Chemical Industry Co., Ltd., solid content: 55%) | 20.0 mass parts |
| Gelatin (10% aqueous solution) | 2.0 mass parts |

-continued

| | |
|---|---|
| Polyvinylpyrrolidone (trade name: K-90, manufactured by ISP Japan Ltd.) | 0.5 mass part |
| The above-described polyether-modified silicone S1-4 (100%) | 1.5 mass parts |
| Water | 50.0 mass parts |

(Preparation of Sample 103)

Sample 103 was prepared in the same manner as sample 101, except that the coating liquid for receptor layer 1 for sample 101 was changed to the following coating liquid for receptor layer 3.

(Composition)

Coating Liquid for Receptor Layer 3:

| | |
|---|---|
| Vinyl chloride/acrylic copolymer latex (trade name: Vinybran 900, manufactured by Nissin Chemical Industry Co., Ltd., solid content: 40%) | 20.0 mass parts |
| Vinyl chloride/acrylic copolymer latex (trade name: Vinybran 690, manufactured by Nissin Chemical Industry Co., Ltd., solid content: 55%) | 20.0 mass parts |
| Gelatin (10% aqueous solution) | 2.0 mass parts |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Nonionic surfactant (trade name: SURFYNOL 440, manufactured by Nisshin Chemicals Co., Ltd.) | 0.5 mass part |
| Water | 50.0 mass parts |

(Preparation of Sample 104)

Sample 104 was prepared in the same manner as sample 101, except that the coating liquid for receptor layer 1 for sample 101 was changed to the following coating liquid for receptor layer 4.

(Composition)

Coating Liquid for Receptor Layer 4:

| | |
|---|---|
| Vinyl chloride/acrylic copolymer latex (trade name: Vinybran 900, manufactured by Nissin Chemical Co., Ltd., solid content: 40%) | 20.0 mass parts |
| Vinyl chloride/acrylic copolymer latex (trade name: Vinybran 690, manufactured by Nissin Chemical Co., Ltd., solid content: 55%) | 20.0 mass parts |
| Gelatin (10% aqueous solution) | 2.0 mass parts |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Sodium dodecylbenzenesulfonate | 0.5 mass part |
| Water | 50.0 mass parts |

(Preparation of Sample 105)

Sample 105 was prepared in the same manner as sample 104, except that the polyether-modified silicone S1-4 in sample 104 was changed to the polyether-modified silicone S1-1 (100%).

(Preparation of Sample 106)

Sample 106 was prepared in the same manner as sample 101, except that the coating liquid for receptor layer 1 for sample 101 was changed to the following coating liquid for receptor layer 5.

(Composition)

Coating Liquid for Receptor Layer 5:

| | |
|---|---|
| Vinyl chloride/acrylic copolymer latex (trade name: Vinybran 900, manufactured by Nissin Chemical Co., Ltd., solid content: 40%) | 20.0 mass parts |
| Vinyl chloride/acrylic copolymer latex (trade name: Vinybran 690, manufactured by Nissin Chemical Co., Ltd., solid content: 55%) | 20.0 mass parts |
| Gelatin (10% aqueous solution) | 2.0 mass parts |
| Polyvinylpyrrolidone (trade name: K-90, manufactured by ISP Japan Ltd.) | 0.5 mass part |
| The above-described polyether-modified silicone S1-1 (100%) | 1.5 mass parts |
| Anionic surfactant A1-1 | 0.5 mass part |
| Water | 50.0 mass parts |

(Preparation of Sample 107)

Sample 107 was prepared in the same manner as sample 106, except that the polyether-modified silicone S1-1 in sample 106 was changed to the polyether-modified silicone S1-4 (100%).

(Preparation of Sample 108)

Sample 108 was prepared in the same manner as sample 107, except that the anionic surfactant A1-1 in sample 107 was changed to the anionic surfactant A1-2.

(Preparation of Sample 109)

Sample 109 was prepared in the same manner as sample 107, except that the anionic surfactant A1-1 in sample 107 was changed to the anionic surfactant A2-1.

(Preparation of Sample 110)

Sample 110 was prepared in the same manner as sample 106, except that the polyether-modified silicone S1-1 in sample 106 was changed to the polyether-modified silicone S1-2 (100%).

(Preparation of Sample 111)

Sample 111 was prepared in the same manner as sample 106, except that the polyether-modified silicone S1-1 in sample 106 was changed to the polyether-modified silicone S1-5 (100%).

(Image-Forming Method)

Fujifilm thermal photoprinter ASK-2000 (trade name, manufactured by FUJIFILM CORPORATION) was used as a printer for image formation. A heat transfer sheet specific for the printer and the heat-sensitive transfer image-receiving sheets mentioned above were processed to be suitable for loading, and printing of images was carried out.

(Image Evaluation)

(Evaluation of Releasability 1)

In regard to image formation, for samples that had been placed under the following printing environments as described below, 50 sheets were uninterruptedly printed in a printing environments as described below, and the separation lines and fusion on the printed images were evaluated on the basis of the following criteria. Regarding the images, three type of images such as a portrait (indoors), a portrait (outdoors, night scene) and a solid black image were printed.

Storage/Printing Environment Conditions

The heat-sensitive transfer sheets, the heat-sensitive image-receiving sheets and the printer were stored for 12 hours under an environment at a temperature of 30° C. and a humidity of 70%, and printing was performed under the same conditions.

5: Separation lines cannot be recognized at all by visual inspection.

4: Separation lines are present to an extent that can be barely recognized, and do not cause actual obstruction in image appreciation.

3: Separation lines are observed in some areas, but do not cause actual obstruction in image appreciation.

2: Conspicuous separation lines appear in some area of the image and disturb image appreciation.

1: Conspicuous separation lines appear over the entire image and disturb image appreciation.

In other cases, the heat-sensitive transfer sheet and the heat-sensitive transfer image-receiving sheet fuse together, and printing is impossible.

(Evaluation of Image Defects)

Gray solid images at a density of 0.4 were obtained under normal temperature and normal humidity environment conditions using the printer for image formation described above, and an evaluation was made on the image defects that are causative of failure in the coated surface state, which occur in the printed surfaces when 100 sheets are printed.

5: Image defects are not at all recognized in 100 sheets.

4: Image defects sporadically occur in 1 to 5 sheets out of 100 sheets, but the defects are present to an extent that is allowable for actual use.

3: Image defects sporadically occur in 6 to 15 sheets out of 100 sheets, but the defects are present to an extent that is allowable for actual use.

2: Image defects are observed in 16 to 39 sheets out of 100 sheets, and the image quality may cause a problem in actual use.

1: Image defects are observed in 40 sheets or more out of 100 sheets, and the image quality may cause a problem in actual use.

in formula (S1) for the polyether-modified silicone is used, image defects that are causative of coating failure upon production can be more effectively reduced.

Example 2

Evaluation of Releasability 2

In regard to image formation, printing and evaluation were carried out all in the same manner as in the case of sample 106 in Example 1, except that the storage/printing environment conditions of the method in the section "Evaluation of releasability 1" were changed to the following conditions.

Storage/Printing Environment Conditions

The heat-sensitive transfer sheets, the heat-sensitive image-receiving sheets and the printer were stored for 12 hours under an environment at a temperature of 35° C. and a humidity of 80%, and printing was performed under the same conditions.

(Evaluation of Gloss Unevenness 1)

In regard to image formation, printing was carried out in the same manner except that the storage/printing environment conditions for the method in the section "Evaluation of releasability 1" were changed to the following conditions, and three types of images such as a portrait (outdoors, night scene), a solid black image and a black-and-white patterned image were printed out.

Storage/Printing Environment Conditions

The heat-sensitive transfer sheets, the heat-sensitive image-receiving sheets and the printer were stored for 12 hours under an environment at a temperature of 30° C. and a humidity of 70%, and printing was performed under the same conditions.

TABLE 2

| Heat-sensitive transfer image-receiving sheet | Silicone releasing agent | Surfactant | | Releasability 1 (30° C., 70%) | Image defects |
|---|---|---|---|---|---|
| | | Kind | Ionic character | | |
| 101 (Comparative example) | KF-6004 | None | — | 1 | 3 |
| 102 (Comparative example) | S1-4 | None | — | 2 | 1 |
| 103 (Comparative example) | S1-4 | SURFYNOL 440 (manufactured by Nisshin Chemicals Co., Ltd.) | Nonionic surfactant | 2 | 1 |
| 104 (Comparative example) | S1-4 | Sodium dodecylbenzenesulfonate | Anionic surfactant | 2 | 1 |
| 105 (Comparative example) | S1-1 | Sodium dodecylbenzenesulfonate | Anionic surfactant | 2 | 1 |
| 106 (This invention) | S1-1 | A1-1 | Anionic surfactant | 4 | 3 |
| 107 (This invention) | S1-4 | A1-1 | Anionic surfactant | 5 | 5 |
| 108 (This invention) | S1-4 | A1-2 | Anionic surfactant | 5 | 4 |
| 109 (This invention) | S1-4 | A2-1 | Anionic surfactant | 5 | 4 |
| 110 (This invention) | S1-2 | A1-1 | Anionic surfactant | 5 | 5 |
| 111 (This invention) | S1-5 | A1-1 | Anionic surfactant | 5 | 5 |

From the results in the above Table, it can be seen that the heat-sensitive transfer image-receiving sheets 106 to 111 of the present invention exhibit marked effects in terms of peelability and image quality, as compared with the heat-sensitive transfer image-receiving sheets 102 to 105 of the Comparative Examples.

From a comparison of the heat-sensitive transfer image-receiving sheet 106 and the heat-sensitive transfer image-receiving sheets 107, 110 and 111, it was found that when a polyether-modified silicone having an $a_1$ value of 30 or more 5: Gloss unevenness cannot be recognized at all by visual inspection.

4: Gloss unevenness is present to an extent that can be barely recognized, and does not cause actual obstruction in image appreciation.

3: Gloss unevenness is observed in some areas, but does not cause actual obstruction in image appreciation.

2: Conspicuous gloss unevenness appears in some area of the image and disturbs image appreciation.

1: Conspicuous gloss unevenness appears over the entire image and disturbs image appreciation.

TABLE 3

| Heat-sensitive transfer image-receiving sheet | Silicone releasing agent | Surfactant Kind | Surfactant Ionic character | Releasability 2 (35° C., 80%) | Gloss unevenness 1 (30° C., 70%) |
|---|---|---|---|---|---|
| 107 (This invention) | S1-4 | A1-1 | Anionic surfactant | 5 | 5 |
| 108 (This invention) | S1-4 | A1-2 | Anionic surfactant | 3 | 3 |
| 109 (This invention) | S1-4 | A2-1 | Anionic surfactant | 4 | 4 |
| 110 (This invention) | S1-2 | A1-1 | Anionic surfactant | 4 | 5 |
| 111 (This invention) | S1-5 | A1-1 | Anionic surfactant | 4 | 5 |

From the results described above, it can be seen that the heat-sensitive transfer image-receiving sheet 107 among the Examples of the present invention is excellent in view of using a surfactant having a branched alkyl group in particular as the anionic surfactant represented by formula (A1).

Example 3

Preparation of Sample 112

Sample 112 was prepared in the same manner as sample 101, except that the coating liquid for receptor layer 1 for sample 101 was changed to the following coating liquid for receptor layer 6.

(Composition)

Coating Liquid for Receptor Layer 6:

| | |
|---|---|
| Vinyl chloride/acrylic copolymer latex (trade name: Vinybran 900, manufactured by Nissin Chemical Industry Co., Ltd., solid content: 40%) | 20.0 mass parts |
| Vinyl chloride/acrylic copolymer latex (trade name: Vinybran 690, manufactured by Nissin Chemical Industry Co., Ltd., solid content: 55%) | 20.0 mass parts |
| Gelatin (10% aqueous solution) | 2.0 mass parts |
| Polyvinylpyrrolidone (trade name: K-90, manufactured by ISP Japan Ltd.) | 0.5 mass part |
| The above-described polyether-modified silicone S1-4 (100%) | 1.5 mass parts |
| Anionic surfactant A1-1 | 0.5 mass part |
| Surfactant (H)-3 | 0.2 mass part |
| Water | 50.0 mass parts |

(Evaluation of Gloss Unevenness 2)

In regard to image formation, printing was carried out in the same manner except that the storage/printing environment conditions for the method in the section "Evaluation of releasability 1" were changed to the following conditions, and three types of images such as a portrait (outdoors, night scene), a solid black image and a black-and-white patterned image were printed out.

Storage/Printing Environment Conditions

The heat-sensitive transfer sheets, the heat-sensitive image-receiving sheets and the printer were stored for 12 hours under an environment at a temperature of 30° C. and a humidity of 70%, and printing was performed under the same conditions.

TABLE 4

| Heat-sensitive transfer image-receiving sheet | Silicone releasing agent | Surfactant Kind | Surfactant Ionic character | Image defects | Releasability 2 (35° C., 80%) | Gloss unevenness 2 (35° C., 80%) |
|---|---|---|---|---|---|---|
| 107 (This invention) | S1-4 | A1-1 | Anionic surfactant | 5 | 5 | 4 |
| 109 (This invention) | S1-4 | A2-1 | Anionic surfactant | 4 | 4 | 3 |
| 112 (This invention) | S1-4 | A1-1 | Anionic surfactant | 5 | 5 | 5 |
| | | (H)-3 | Anionic surfactant | | | |

From the results described in the table above, it can be seen that the sample 112 of the present invention is a high-quality heat-sensitive transfer image-receiving sheet having excellent releasability, which can be stably produced with fewer image defects that are causative of coating failure upon production, and can prevent separation lines and gloss unevenness even under a high-temperature and high-humidity environment, supposedly during the rainy season or in summertime.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2009-179903 filed in Japan on Jul. 31, 2009, which is entirely herein incorporated by reference.

What we claim is:

1. A heat-sensitive transfer image-receiving sheet comprising, on a support, at least one heat insulation layer and at least one receptor layer in this sequence, the receptor layer containing a latex polymer and a polyether-modified silicone represented by the following formula (S1), and the receptor layer containing at least one anionic surfactant represented by the following formula (A1) or (A2):

Formula (S1)

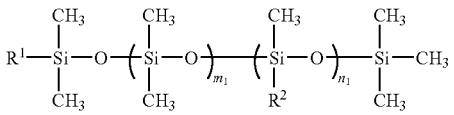

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represent a positive integer, a1 represents a positive integer; and $b_1$ represents 0 or a positive integer;

Formula (A1)

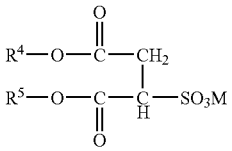

wherein $R^4$ and $R^5$ each independently represent an alkyl group having 3 to 20 carbon atoms; and M represents a hydrogen atom or a cation; and Formula (A2)

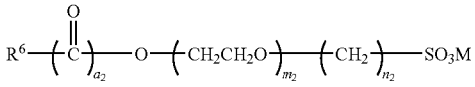

wherein $R^6$ represents an alkyl group or an alkenyl group, each having 6 to 20 carbon atoms; M represents a hydrogen atom or a cation; $m_2$ represents the average number of added moles, and is larger than 0 and equal to or less than 10; $n_2$ represents an integer of 0 to 4; and $a_2$ represents 0 or 1.

2. The heat-sensitive transfer image-receiving sheet according to claim 1, wherein $R^4$ and $R^5$ in formula (A1) each independently represent a branched alkyl group having 4 to 10 carbon atoms.

3. The heat-sensitive transfer image-receiving sheet according to claim 1, wherein $a_1$ in the group represented by $R^2$ in formula (S1) is an integer of 30 or more.

* * * * *